US006089788A

United States Patent [19]

Sandanasamy

[11] Patent Number: 6,089,788

[45] Date of Patent: Jul. 18, 2000

[54] VERTICAL DRAIN

[75] Inventor: Richard Douglas Sandanasamy, Singapore, Singapore

[73] Assignee: RasWILL Representative Pte. Ltd., Singapore, Singapore

[21] Appl. No.: 09/052,874

[22] Filed: Mar. 31, 1998

[30] Foreign Application Priority Data

Apr. 10, 1997 [SG] Singapore ..... 9701114-2

[51] Int. Cl.[7] ..... E02B 11/00

[52] U.S. Cl. ..... 405/50; 405/36; 405/43; 405/258

[58] Field of Search ..... 405/50, 43, 232, 405/45, 36, 128, 131, 258; 210/170

[56] References Cited

U.S. PATENT DOCUMENTS

| | | | |
|---|---|---|---|
| 3,371,492 | 3/1968 | Mise et al. | 405/50 |
| 4,119,511 | 10/1978 | Chistenson | 405/232 X |
| 4,124,483 | 11/1978 | Christenson | 405/232 X |
| 4,157,287 | 6/1979 | Christenson | 405/232 X |
| 4,582,611 | 4/1986 | Wang | 405/50 X |
| 4,622,138 | 11/1986 | Wager | 405/50 X |
| 5,037,240 | 8/1991 | Sherman | 405/50 X |
| 5,240,570 | 8/1993 | Chang et al. | 405/128 X |

OTHER PUBLICATIONS

Leo Casagrande, Boston Civil Engineers 69(2), "Stabilization of Soils by Means of Electro–osmosis State–of–the Art", pp 255–302 (1983).

N.C. Lockhart, Colloids and Surfaces, 6, "Electroosmotic Dewatering of Clays. I. Influence of Voltage", pp. 229–251 (1983).

L. Bjerrum, J. Mounm and O. Eide, Geotechnique, 17, "Application of Electro–osmosis to a Foundation Problem in a Norwegian Quick Clay", pp. 214–235 (1967).

*Primary Examiner*—Dennis L. Taylor
*Attorney, Agent, or Firm*—Stoel Rives LLP

[57] ABSTRACT

A vertical drain for draining fluid from ground soil, which drain comprises an elongate core having one or more channels extending along the length of the core to receive fluid; electrically conductive means extending substantially along the length of the core; and a filter surrounding the core, wherein fluid from ground being consolidated passes through the filter into the one or more channels in the core.

20 Claims, 4 Drawing Sheets

VERTICAL DRAIN

This invention relates to a vertical drain and more particularly to a vertical drain for use in consolidating weak or soft soils.

Before infrastructure or buildings can be developed in an area, it is necessary that the ground upon which the development is to take place is adequately consolidated in order to take the load of the infrastructure or building. This is especially true where construction is to take place on reclaimed land. Large amounts of clay, silty clay and marine clay are to be found in many areas inland and onshore where land is to be reclaimed. These weak soils have a high water content which must be reduced so that the ground can consolidate before construction can take place.

Early methods of ground consolidation involve the use of sand drains. These are vertical bores filled with sand which extend down into the ground to be consolidated. A surcharge load such as a large volume of sand is deposited over the bores on the ground to be consolidated. The pressure exerted by the sand on the ground forces water in the weak soils into and up the sand drains thereby consolidating the ground. Such an arrangement is shown in FIG. 1 of the accompanying drawings.

Without the use of sand drains, a surcharge load placed on the surface to compress and thereby consolidate the weak soil below will take several years to settle completely or achieve a desired level of consolidation, i.e. 90 to 95%, to render the land suitable for construction. However, by using sand drains, this period is reduced to only a few months depending upon the soil condition, the spacing of the drains and the weight of the surcharge load.

Sand drains have been replaced with so-called prefabricated vertical drains (PVD). PVD's comprise an elongate plastics corrugated core surrounded by a filter cloth. Water is flee to pass through the filter cloth into the corrugations of the plastic core. The corrugations define a series of elongate channels in the core. The water in the vertical drain is thereby forced up through the channels to the surface by the pressure of the surcharge load placed on the ground being consolidated or can be drawn up the vertical drain by use of a vacuum suction system. An example of a PVD is shown in FIG. 2A of the accompanying drawings.

A mesh like structure can be used instead of the corrugated core profile. A prefabricated vertical drain incorporating the mesh like structure is shown in FIG. 2B of the accompanying drawings.

The rate of consolidation using prefabricated vertical drains after 60% consolidation has been achieved begins to slow. The waiting period necessary to achieve further consolidation is lengthy and, therefore, in most circumstances impractical. In order to speed up the consolidation process, it is known to increase the surcharge load on the ground being consolidated but there are associated problems with this solution such as the instability of the surcharge load above the ground being consolidated, shortage of surcharge material and the extra time and cost needed to deposit the further surcharge.

This invention seeks to provide an improved vertical drain which does not suffer from the above-mentioned problems and which allows the acceleration of the consolidation process.

Accordingly, one aspect of the present invention provides a vertical drain for draining fluid from ground soil, which drain comprises an elongate core having one or more channels extending along the length of the core to receive fluid; electrically conductive means extending substantially along the length of the core; and a filter surrounding the core, wherein fluid from ground being consolidated passes through the filter into the one or more channels in the core.

A further aspect of the present invention provides an array of vertical drains comprising: a plurality of vertical drains according to any preceding claim connectable to a negative terminal of a power source; and a plurality of electrically conductive means connectable to a positive terminal of a power source.

Another aspect of the present invention provides a method of consolidating ground soil by draining fluid from ground soil comprising the steps of: introducing an array of vertical drains having electrically conductive means therein into ground to be consolidated; providing a surcharge load on the ground to be consolidated to cause hydraulic consolidation of the ground, fluid being drained from the ground through the vertical drains; and connecting the electrically conductive means in the vertical drains to a power source to initiate electro-osmotic consolidation of the ground to be consolidated.

In order that the present invention may be more readily understood, embodiments thereof will now be described, by way of example, with reference to the accompanying drawings, in which.

Figure 1:
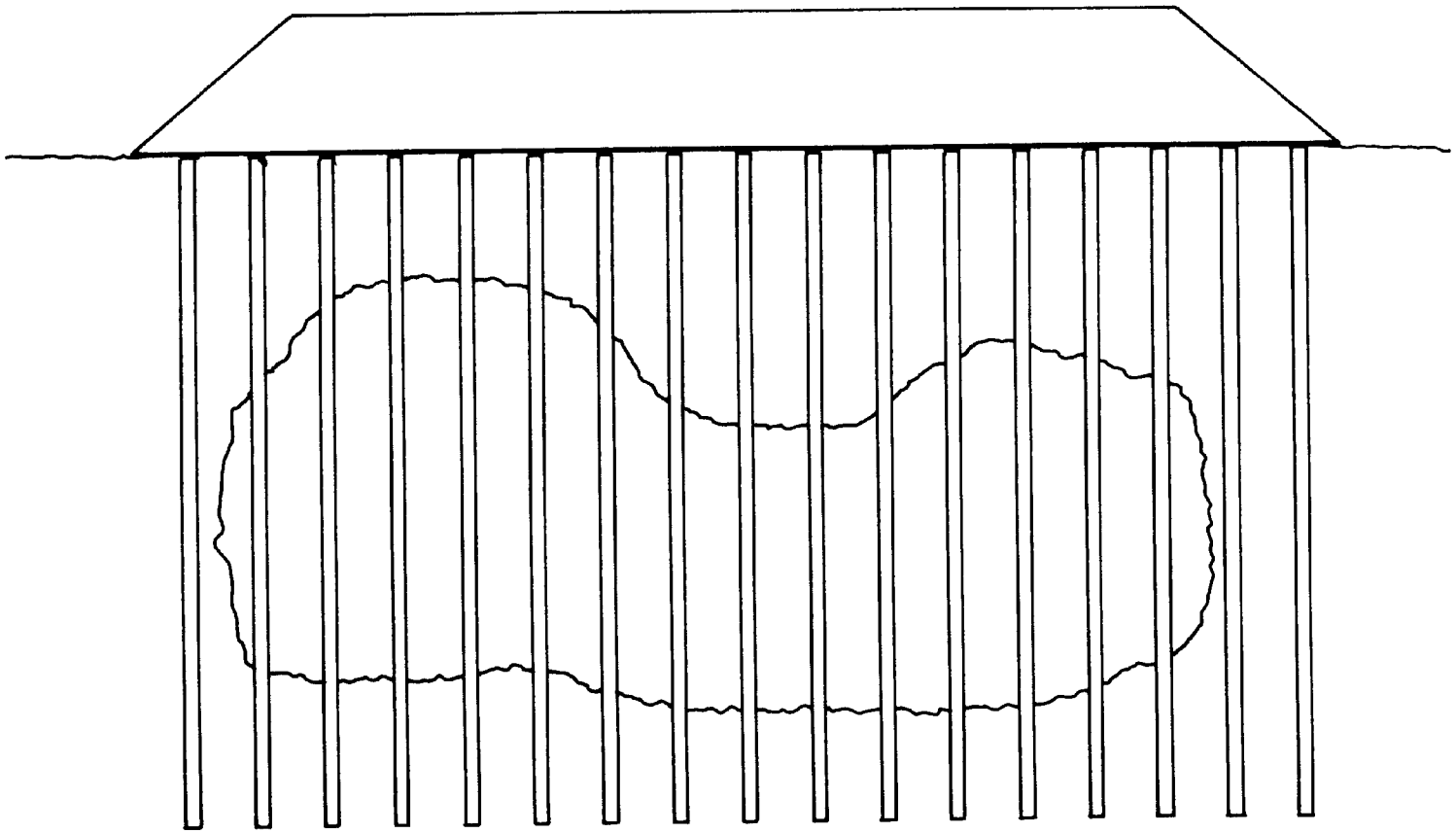
FIG. 1 is a cross-section through a schematic representation of a conventional ground consolidation system using sand drains or prefabricated vertical drains.
Figure 2A:
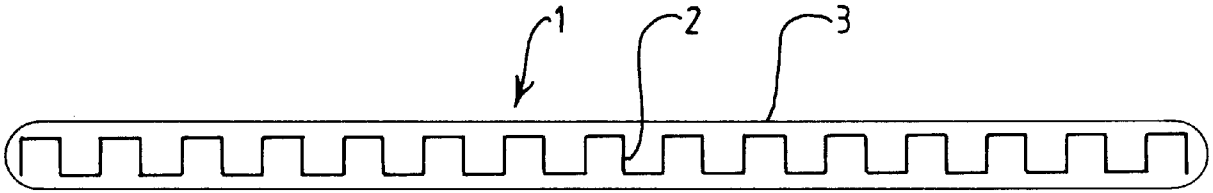
FIG. 2A is a cross-section through a known prefabricated vertical drain.
Figure 2B:
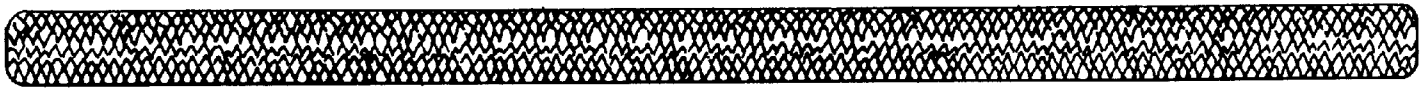
FIG. 2B is a cross-section through another form of a pre-fabricated vertical drain.
Figure 3:
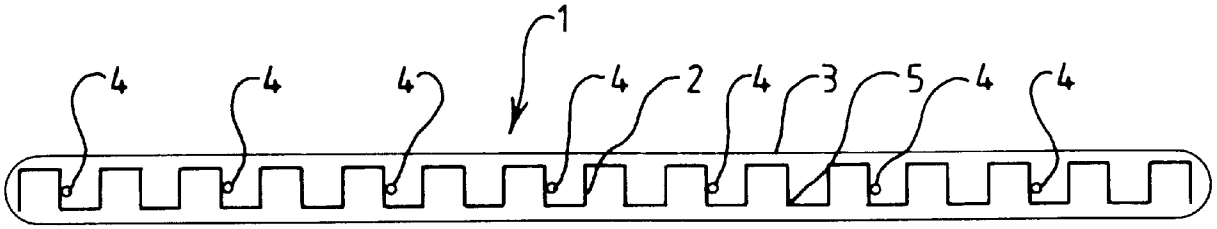
FIG. 3 is a cross-section through a vertical drain embodying the present invention.

Referring to FIG. 3, a vertical drain 1 embodying the present invention comprising a corrugated plastics core 2 which is surrounded by a synthetic filter cloth 3. In the example shown in FIG. 3, the vertical drain has a thickness in the region of 3 mm, a nominal width of 100 mm and a length in the region of 50 m or more. The drain is manufactured in coiled lengths of 200 m or more. Preferably, the plastics materials from which the plastics core is manufactured is polypropylene or polyethylene or other extrudable plastics. The synthetics filter cloth is preferably manufactured from polypropylene or polyethylene or other synthetic fibres and is sufficiently porous to allow water to permeate through the filter cloth into the corrugations 5 of the plastics core. Preferably, the average pore size of the synthetic filter cloth is in the region of 75 to 200 microns.

The corrugations 5 in the plastics core define a series of channels extending along the vertical drain, which channels are open to the synthetic filter cloth surrounding the core such that water permeating through the filter cloth is received in the one or more channels.

Conveniently, the conjugated plastics core 2 is manufactured by extrusion. Either after extrusion or during the extrusion process, one or more electrically conductive strips 4 such as, for example, copper wire are attached or embedded along the length of the plastics core 2. The electrically conductive strips 4 run continuously from one end of the vertical drain along the length of the plastics core 2 to the other end of the vertical drain.

A vertical drain embodying the present invention may dispense with the electrically conductive strips 4 by utilising a plastics core 2 manufactured from an electrically conductive resin. Either all the plastics core 2 or selected areas of the plastics core are manufactured from the electrically conductive resin. Examples of appropriate electrically conductive resins are polypropylene and polyethylene base resins which are compounded with carbon to produce electrically conductive polypropylene and electrically conductive polyethylene. Such resins are readily available in extrusion grade.

Figure 4:
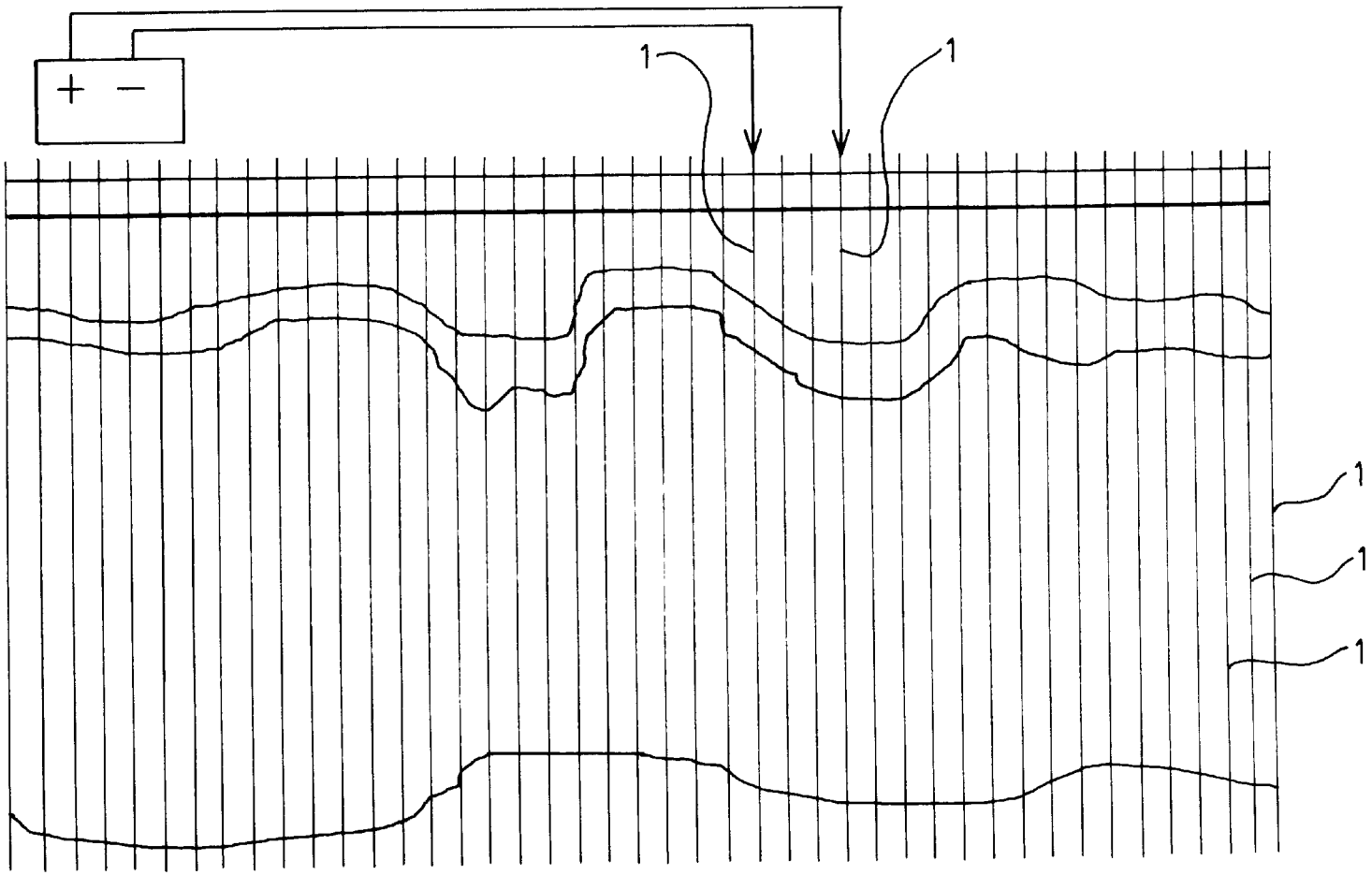
FIG. 4 is a cross-section through a schematic representation of ground being consolidated provided with vertical drains embodying the present invention.
Figure 5:
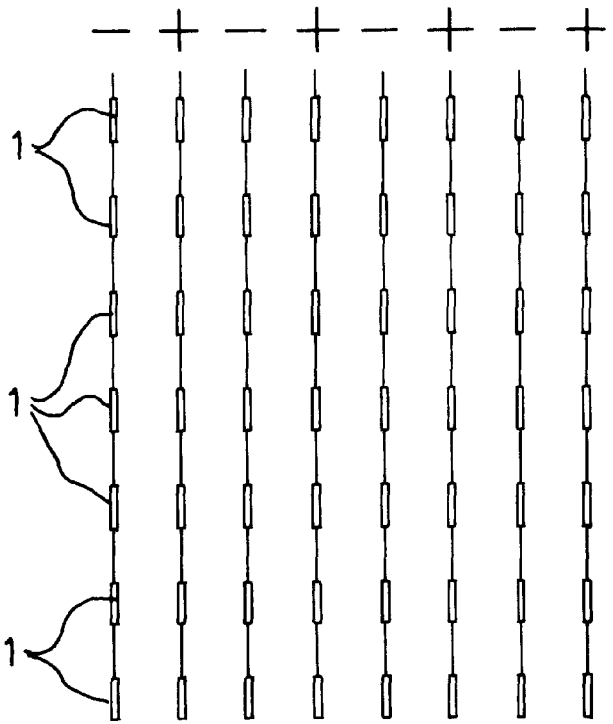
FIG. 5 is a schematic plan view of a square grid of vertical drains embodying the present invention.

In use, vertical drains embodying the present invention are inserted in a square grid of bores in the area of ground to be consolidated. The grid of the drains defines an array of rows and columns of drains which are spaced apart by between 1.0 m to 1.5 m. This arrangement is shown schematically in FIGS. 4 and 5. A DC power source such as high capacity wet cells, an on-site generator or a connection to a grid supply is connected to the vertical drains by means of connector terminals which are exposed above the surface of the ground to be consolidated. In the array of vertical drains, alternate rows of vertical drains are connected to either a negative or positive terminal of the power supply such that a first row of vertical drains comprises a row of anodes, a second row of vertical drains comprises a row of cathodes and so on.

A surcharge load is placed over the area of ground to be consolidated. The provision of the surcharge load begins a process of hydraulic consolidation of the ground beneath the surcharge load. As the ground consolidates, the water content of the ground reduces as water passes through the synthetic filter cloths 3 of the vertical drains 1 into the conjugations 5 of the plastics core 2 and up and out of the vertical drains 1. As previously discussed, after about 60% consolidation has taken place, the rate of hydraulic consolidation begins to slow considerably. However, using the vertical drains embodying the present invention, the rate of consolidation can be re-accelerated by implementing an electro-osmotic consolidation of the ground through which the vertical drains 1 pass. The DC supply to the array of vertical drains 1 is switched on thereby beginning the electro-osmotic consolidation process. The electro-osmotic consolidation process results in water being attracted to the cathode vertical drains 1.

It should be appreciated that whilst the electro-osmotic consolidation is taking place, there is still a certain amount of hydraulic consolidation taking place. Since the construction of the vertical drains 1 for use as both cathodes and anodes is identical, the hydraulic consolidation will still cause a certain amount of water to be present in the anode vertical drains. The water present in the anode vertical drains is being attracted to the cathode vertical drains through the ground being consolidated. Thus, a certain amount of electrical energy could be considered to be being wasted. Therefore, in one consolidation system embodying the present invention, the cathode vertical drains are produced as previously described whereas the anodes in the array of vertical drains comprise solid cores without corrugations to prevent water being collected in the anodes.

Figure 6:
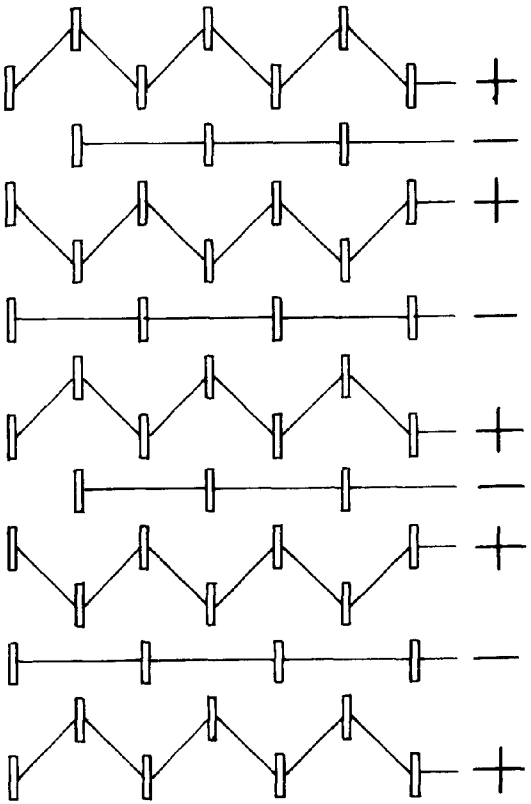
FIG. 6 is a schematic plan view of a triangular grid of vertical drains embodying the present invention.

Whilst the array of vertical drains has been described as a square array, other allay patterns are possible using, for example, the triangular grid pattern shown in FIG. 6.

What is claimed is:

1. A vertical drain for draining fluid from ground soil, comprising:

an elongate core having at least one channel extending along the length of the core to receive fluid;

electrically conductive means in contact with or forming part of the core and extending substantially along the length of the core; and a synthetic filter surrounding the core and the electrically conductive means, wherein fluid from ground being consolidated passes through the filter into the at least one channel in the core.

2. A vertical drain according to claim 1, wherein the core comprises an electrically conductive resin.

3. A vertical drain according to claim 1, wherein the electrically conductive means comprises an electrically conductive strip.

4. A vertical drain according to claim 3, wherein the strip is located in a channel of the core.

5. A vertical drain according to claim 3, wherein the strip is attached to the core.

6. A vertical drain according to claim 3, wherein the snip is embedded in the core.

7. A vertical drain according to claim 3, wherein the strip comprises a copper wire.

8. A vertical drain according to claim 1, wherein the core is an extrusion.

9. A vertical drain according to claim 8, wherein the electrically conductive means is part of the core extrusion.

10. An array of vertical drains comprising: a plurality of vertical drains according to claim 1 connectable to a negative terminal of a power source; and a plurality of electrically conductive means connectable to a positive terminal of a power source.

11. An array according to claim 10, wherein the electrically conductive means connectable to the positive terminal of the power source do not include any channels to receive fluid from the ground soil.

12. An array according to claim 10, wherein the electrically conductive means connectable to the positive terminal of the power source comprise the electrically conductive means of further vertical drains according to claim 1.

13. A method of consolidating ground soil by draining fluid from ground soil comprising:

introducing an array of vertical drains having a core and electrically conductive means therein into ground to be consolidated, the electrically conductive means contacting or forming, part of the core and extending along the length of the core, and the core and the electrically conductive means being surrounded by a synthetic filter;

providing a surcharge load on the ground to be consolidated to cause hydraulic consolidation of the ground, fluid being drained from the ground through the vertical drains; and connecting the electrically conductive means in the vertical drains to a power source to initiate electro-osmotic consolidation of the ground to be consolidated.

14. The method of claim 13 further comprising:

connecting the electrically conductive means in the form of an electrically conductive copper wire extending along a length of the core in at least one of the vertical drains to a negative terminal of the power source.

15. The method of claim 13 further comprising;

connecting the electrically conductive means in the form of an electrically conductive resin forming part of and extending along a length of the core in at least one of the vertical drains to a negative terminal of the power source.

16. The method of claim 15 further comprising:

spacing the vertical drains are spaced apart by a distance of at least 1.0 m;

connecting a first electrically conductive means of a first vertical drain to a positive terminal of the power source; and connecting a second electrically conductive means of a second vertical drain to a negative terminal of the power source.

17. The method of claim 15 further comprising employing polypropylene or polyethylene compounded with carbon for the electrically conductive resin.

18. A vertical drain according to claim 2 wherein the electrically conductive resin comprises polypropylene or polyethylene compounded with carbon.

19. A vertical drain according to claim 1 wherein the core further comprises multiple channels extending along the length of the core to receive fluid and multiple electrically conductive strips in contact with or forming part of the channels, wherein all the channels and electrically conductive strips of the drain are surrounded by the synthetic filter.

20. A vertical drain according to claim 19 wherein the multiple electrically conductive strips are all connected to a negative terminal of the power source.

* * * * *